US010716965B2

(12) United States Patent
Liu

(10) Patent No.: US 10,716,965 B2
(45) Date of Patent: Jul. 21, 2020

(54) EXERCISE MACHINE

(71) Applicant: Dyaco International Inc., Taipei (TW)

(72) Inventor: Han-Lin Liu, Taipei (TW)

(73) Assignee: Dyaco International Inc., Taipei (TW)

( * ) Notice: Subject to any disclaimer, the term of this patent is extended or adjusted under 35 U.S.C. 154(b) by 20 days.

(21) Appl. No.: 16/233,777

(22) Filed: Dec. 27, 2018

(65) Prior Publication Data

US 2020/0188727 A1 Jun. 18, 2020

(30) Foreign Application Priority Data

Dec. 12, 2018 (TW) ..... 107144863 A

(51) Int. Cl.
*A63B 22/00* (2006.01)
*A63B 21/00* (2006.01)
*A63B 21/22* (2006.01)

(52) U.S. Cl.
CPC ..... *A63B 22/0056* (2013.01); *A63B 21/154* (2013.01); *A63B 21/225* (2013.01); *A63B 21/4034* (2015.10)

(58) Field of Classification Search
CPC . A63B 21/4034; A63B 21/225; A63B 21/154; A63B 22/0056; A63B 21/00; A63B 21/0047; A63B 21/015; A63B 21/155; A63B 21/157; A63B 21/22; A63B 21/0608; A63B 21/227; A63B 21/4033–4035; A63B 22/00–0012; A63B 22/0025–0043; A63B 22/0048; A63B 22/0051; A63B 22/0061; A63B 22/0069–0074; A63B 22/02; A63B 22/04–0611; A63B 22/0641; A63B 22/0647; A63B 22/0664–0694; A63B 23/00; A63B 23/035–0355; A63B 23/03575–0405; A63B 23/0476; A63B 23/12; A63B 23/0458
See application file for complete search history.

(56) References Cited

U.S. PATENT DOCUMENTS 3,213,852 A * 10/1965 Zent ..... A61H 1/0214 601/36
3,777,745 A * 12/1973 Simjian ..... A61H 7/002 601/115
4,822,032 A * 4/1989 Whitmore ..... A63B 21/15 482/6
5,238,462 A * 8/1993 Cinke ..... A63B 22/0056 482/51
10,022,588 B1 * 7/2018 Lee ..... A63B 23/03583
10,226,657 B2 * 3/2019 Smith ..... A63B 22/001
2005/0181912 A1 * 8/2005 Eschenbach ..... A63B 21/154 482/52
2010/0113228 A1 * 5/2010 Wu ..... A63B 21/155 482/72

(Continued)

*Primary Examiner* — Loan B Jimenez
*Assistant Examiner* — Catrina A Letterman
(74) *Attorney, Agent, or Firm* — Donald E. Stout; Stout, Uxa & Buyan, LLP

(57) ABSTRACT

An exercise machine includes a supporting mechanism, two driving units, and a resistance device. The supporting mechanism is used to support the two driving units and the resistance device. The two driving units are respectively disposed at the left and right side of the supporting mechanism for the user to operate. The resistance device can be operated in both directions to eliminate the blockage when switching the operation direction.

10 Claims, 7 Drawing Sheets

(56) References Cited

U.S. PATENT DOCUMENTS

| | | | | |
|---|---|---|---|---|
| 2013/0012363 | A1* | 1/2013 | Eschenbach | A63B 21/00069 482/52 |
| 2014/0249000 | A1* | 9/2014 | Lu | A63B 22/0664 482/52 |
| 2015/0246260 | A1* | 9/2015 | Giannelli | A63B 23/0476 482/8 |
| 2016/0263431 | A1* | 9/2016 | Huang | A63B 22/0056 |
| 2018/0339189 | A1* | 11/2018 | Luger | A63B 22/0017 |

* cited by examiner

EXERCISE MACHINE

CROSS-REFERENCE TO RELATED APPLICATIONS

The entire contents of Taiwan Patent Application No. 107144863, filed on Dec. 12, 2018, from which this application claims priority, are expressly incorporated herein by reference.

BACKGROUND OF THE INVENTION

1. Field of the Invention

The present invention relates to an exercise machine, and more particularly to an exercise machine for performing stepping exercise.

2. Description of Related Art

A stepper is an exercise machine that increases heart rate, burns calories, and improves myocardial endurance.

In the traditional stepper design, a user stands on two pedals supported by a given level of resistance. The user lifts alternating feet, as if walking up a set of stairs, so as to build muscle in legs and gluteus. The stair stepper is also a lower-impact training machine compared to a treadmill, making it useful for those with leg injuries.

U.S. Pat. No. 9,566,466 discloses an exercise device for stepping exercise, the main components of which include a frame, two pedals, two first swing arms, two second swing arms, a resistance device, two link rods, two cranks, and two limiting rods. The two pedals enable force to be applied. The two first swing arms are respectively arranged at left side and right side of the frame. The two second swing arms are respectively arranged at left side and right side of the frame, and both first swing arms and both second swing arms have two ends, a first end and a second end, in which the first end of the first swing arm pivotally couples to the frame, and the second end of the first swing arm couples to the first end of one corresponding second swing arm, and the second end of the corresponding second swing arm couples to one corresponding pedal. The resistance device includes a driving wheel and a flywheel. The driving wheel has an axle and couples with the flywheel. The two cranks are respectively arranged at left side and right side of the resistance device, and both cranks and both link rods have two ends, a first end and a second end, in which the first end of each crank couples to the axle, and the second end of each crank couples to a first end of one corresponding link rod, and the second end of the corresponding link rod couples to a portion between the first end and second end of one corresponding second swing arm. Each limiting rod slidably couples with one corresponding second swing arm and has two ends coupling to the frame. The motion of the pedals will drive the driving wheel, which in turn drives the flywheel to rotate.

Taiwan Patent No. M391978 discloses a linear climbing machine comprising a frame unit, a resistance unit, and two link units. The resistance unit includes a first pulley, a second pulley, and a resistance member (flywheel). The first pulley includes two cranks. Each link unit includes a rocker pivoted to the frame unit, a pedal rod pivotally connected to the rocker, a connecting rod pivoted between the rocker and one of the two cranks, and a sliding roller pivoted to the pedal rod. The user's stepping operation drives the first pulley via the crank, the first pulley drives the second pulley to rotate, and the second pulley drives the resistance member (flywheel) to rotate.

Taiwan Patent No. 1626073 discloses an exercise machine comprising: a main frame, a crank mechanism having two cranks disposed on the main frame; two swinging members being pivoted on both sides of the main frame; two bearing members with two front ends pivotally connected to the bottom end of the two swinging members and two rear end formed with two treading portions; two supporting rods having one end pivotally connected to the base of the main frame and the other end pivotally connected to the treading portion of the two bearing members; two connecting rods having an upper connecting portion pivoted to the two cranks and performs a circular path movement with the crank and having a lower connecting portion pivotally connected to the two supporting rods, and wherein the treading portions of the two bearing members are driven by the two connecting rods, and can be reciprocally moved along an arc shape. In addition, the exercise machine also includes a resistance device, which includes a flywheel and a pulley. A shaft of the pulley is connected to the two cranks, and the pulley is connected to the flywheel through a belt. The user's pedaling operation drives the pulley through the crank, and the pulley in turn drives the flywheel to rotate.

In a conventional stepper using a driving mechanism composed of linkage rods, when the stepping motion is performed, the inertia of the flywheel improves the smoothness of the pedaling operation, but this is limited to a large pace (that is, a large reciprocating distance of the pedal). When the stepper operates with a small pace, the inertia of the flywheel cannot immediately convert the stepping operation into the other direction, and hence there is blockage when switching the operation direction.

SUMMARY OF THE INVENTION

In one general aspect, the present invention relates to an exercise machine, and more particularly relates to an exercise machine performing stepping movements.

According to an aspect of the present invention, an exercise machine is provided with a supporting mechanism, two driving units, and a resistance device. The supporting mechanism comprises a base located on a supporting plane or a floor and a frame located on the base and connected to the base. The two driving units are respectively disposed at a left side and a right side of the frame for the user to operate. The resistance device comprising a first transmission wheel, a second transmission wheel, a third transmission wheel, a fourth transmission wheel, a fifth transmission wheel, a first axle, a second axle, a first one-way bearing, a second one-way bearing, a flywheel, a first transmission member, a second transmission member, and a third transmission member. The first transmission wheel is disposed at a first side of the frame. The second transmission wheel is disposed at a second side of the frame. The first axle passes through the frame and is a common axle of the first transmission wheel and the second transmission wheel. The first axle has two ends with each connecting to one corresponding driving unit. The third transmission wheel is rotatably mounted on the frame. The fourth transmission wheel is disposed at a first side of the third transmission wheel. The fifth transmission wheel is disposed at a second side of the third transmission wheel. The second axle passes through the frame and is a common axle of the third transmission wheel, the fourth transmission wheel, and the fifth transmission wheel. The first one-way bearing is disposed between the fourth transmission wheel and the second axle. The second one-way bearing is disposed between the fifth transmission wheel and the second axle. The flywheel is rotatably mounted on the frame. The first transmission member connects the first transmission wheel and the fourth transmission wheel. The second transmission member connects the second transmission wheel and the fifth transmission wheel. The third transmission member connects the third transmission wheel and the flywheel. Wherein the fourth transmission wheel rotates in a first direction and the fifth transmission wheel rotates in a second direction opposite to the first direction, and wherein the kinetic energy of the two driving units is transmitted to the third transmission wheel via one of the fourth transmission wheel and the fifth transmission wheel, and then the third transmission wheel drives the flywheel to rotate.

In one embodiment, the first transmission wheel, the second transmission wheel, the third transmission wheel, the fourth transmission wheel, and the fifth transmission wheel are pulleys, and the first transmission member, the second transmission member, and the third transmission member are belts.

In one embodiment, the resistance device further comprises a sixth transmission wheel and a seventh transmission wheel both being disposed at the second side of the third transmission wheel, and wherein the second transmission member connects to the second transmission wheel, the fifth transmission wheel, the sixth transmission wheel, and the seventh transmission wheel, and the sixth transmission wheel and the seventh transmission wheel are used for adjusting a tension of the second transmission member.

In one embodiment, the first transmission wheel, the second transmission wheel, and the fourth transmission wheel rotate in a same direction.

In one embodiment, the third transmission wheel and the flywheel rotate in a same direction.

In one embodiment, the third transmission wheel rotates in a first direction, and the flywheel rotates in a second direction opposite to the first direction.

In one embodiment, each driving unit comprises: a swing rod having a first end pivotally connected to the frame; a foot rod having a first rod pivotally connected to a second end of the swing rod; a crank having a first end connected to the first axle; a linkage rod having a first end pivotally connected to a second end of the crank and having a second end pivotally connected to a portion between the first end and the second end of the foot rod; a limiting rod having a first end fixed to the frame and having a second end fixed to the base; and a pedal connecting to a second end of the foot rod.

DETAILED DESCRIPTION OF THE PREFERRED EMBODIMENT

Figure 1:
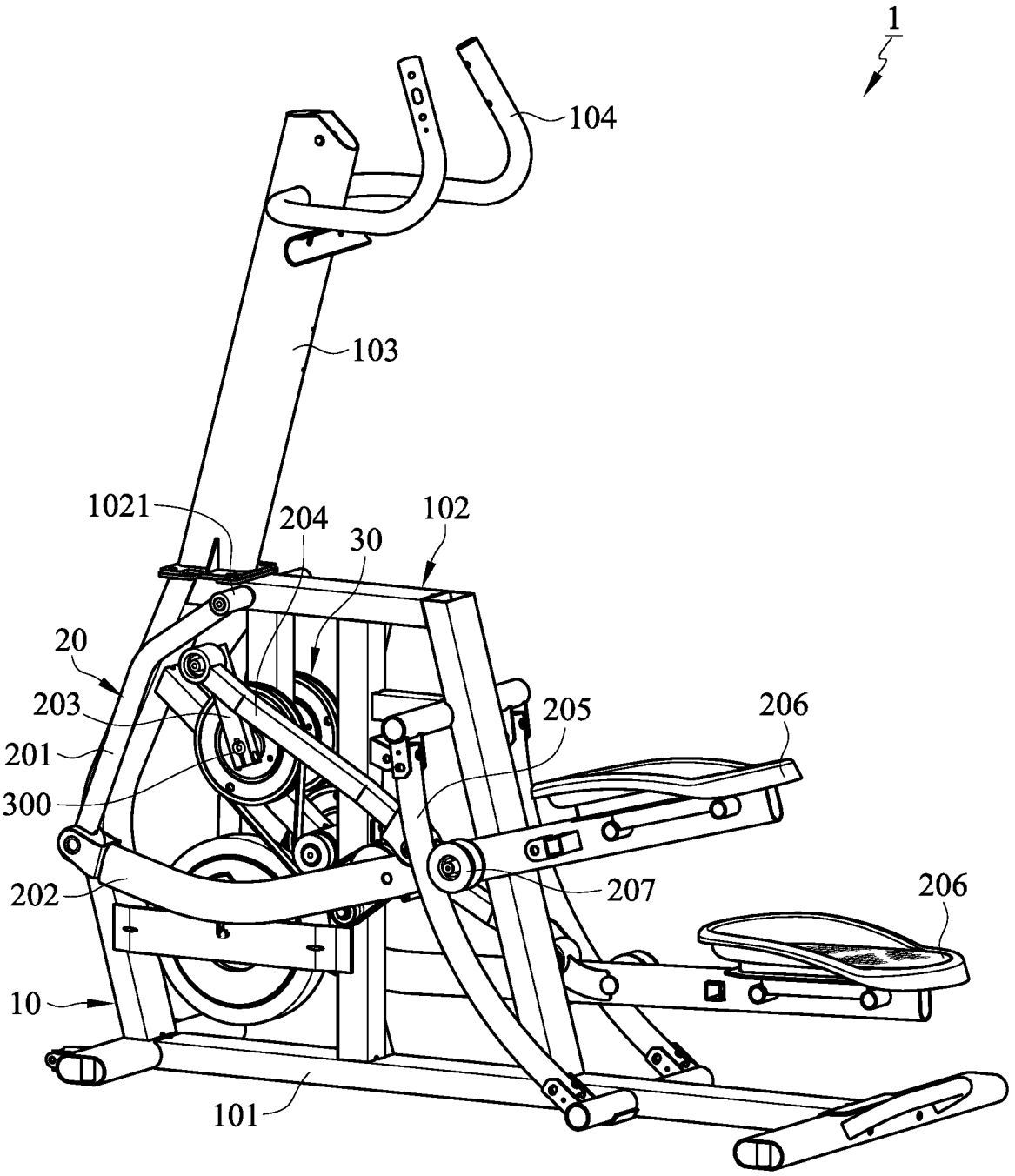
FIG. 1 is a perspective view of an exercise machine provided in accordance with a preferred embodiment of the present invention.

Embodiments of the invention are now described and illustrated in the accompanying drawings, instances of which are to be interpreted to be to scale in some implementations while in other implementations, for each instance, not. In certain aspects, use of like or the same reference designators in the drawings and description refers to the same, similar or analogous components and/or elements, while according to other implementations the same use should not. According to certain implementations, use of directional terms, such as, top, bottom, left, right, up, down, over, above, below, beneath, rear, front, clockwise, and counterclockwise, are to be construed literally, while in other implementations the same use should not. While the invention will be described in conjunction with these specific embodiments, it will be understood that it is not intended to limit the invention to these embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components.

Figure 2:
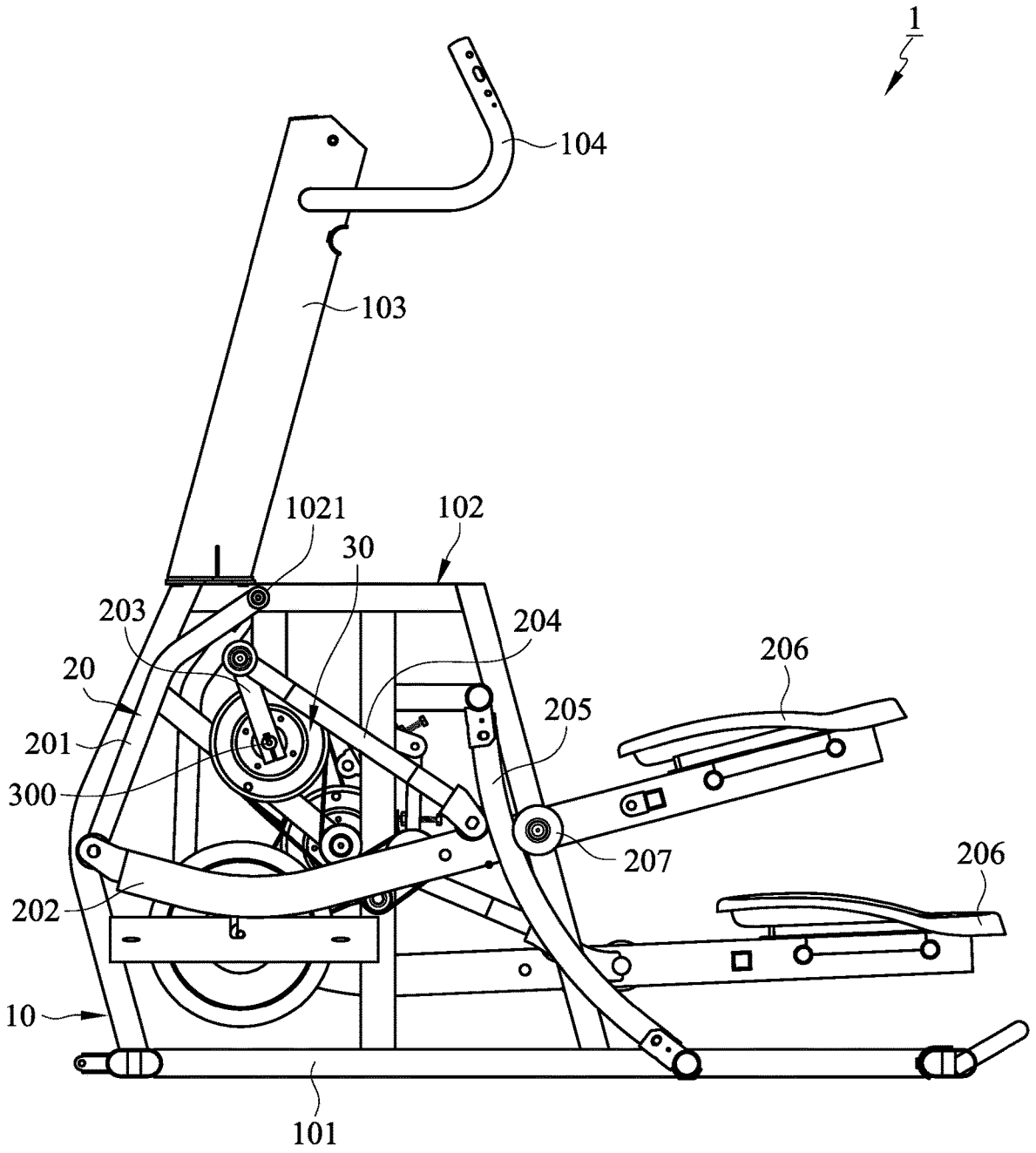
FIG. 2 is a side view of the exercise machine provided in accordance with the preferred embodiment of the present invention.

FIG. 1 is a perspective view of an exercise machine 1 provided in accordance with a preferred embodiment of the present invention. FIG. 2 is a side view of the exercise machine 1. As shown in FIGS. 1 and 2, the exercise machine 1 mainly includes a supporting mechanism 10, two (left and right) driving units 20, and a resistance device 30. The supporting mechanism 10 is used to support the driving unit 20 and the resistance device 30. The driving unit 20 is operated by a user and transmits the kinetic energy applied by the user to the resistance device 30. The resistance device 30 couples to the driving unit 20 to provide the resistance when operating the driving unit 20.

Referring to FIGS. 1 to 2, the supporting mechanism 10 preferably includes, but is not limited to, a base 101 and a frame 102. The base 101 is disposed on a floor or a supporting plane, and the frame 102 is a supporting structure located above the base 101 and coupled to the base 101. The supporting mechanism 10 can also include a post 103. The lower end of the post 103 is connected to the frame 102. The upper end of the post 103 has handles 104 for the user to hold and an operation interface (not shown) for the user to operate and control the exercise machine 1.

As shown in FIGS. 1 and 2, the two driving units 20 are respectively disposed at the left side and right side of the frame 102. Each driving unit 20 preferably includes, but is not limited to: a swing rod 201, a foot rod 202, a crank 203, a linkage rod 204, a limiting rod 205, and a pedal 206.

As shown in FIGS. 1 and 2, a first end of the swing rod 201 is pivotally connected to an axis 1021 of the frame 102, and a second end of the swing rod 201 is pivotally connected to a first end of the foot rod 202, and a second end of the foot rod 202 is coupled to the pedal 206. A first end of the crank 203 is connected to a first axle 300 of the resistance device 30, a second end of the crank 203 is pivotally connected to a first end of the linkage rod 204, and a second end of the linkage rod 204 is pivotally connected to an portion between the first end and the second end of the pedal 202. A first end of the limiting rod 205 is fixed with the frame 102, and a second end of the limiting rod 205 is fixed with the base 101. Preferably, the limiting rod 205 is curve-shaped.

As shown in FIGS. 1 and 2, preferably, each driving unit 20 further includes a roller 207. The axis of the roller 207 is pivoted on the outer side surface between the first end and the second end of the foot rod 202. The roller 207 has a concave groove to fit the limiting rod 205 such that the roller 207 abuts against the curved limiting rod 205. When the pedals 206 are alternately operated, the rollers 207 are moved up and down along the limiting rods 205. The roller 207 can improve the stability of the pedal 206 during movement.

Figure 3A:
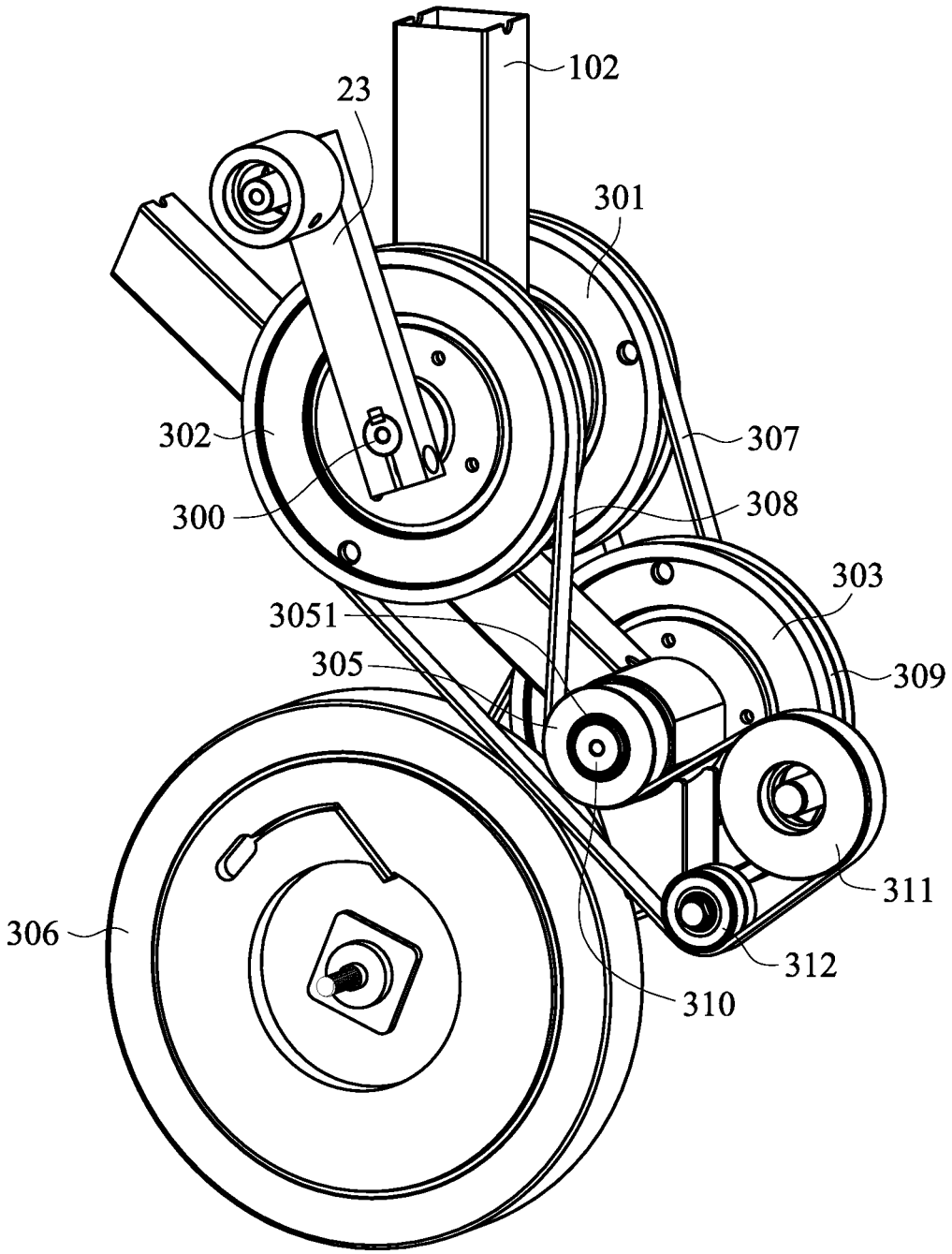
FIG. 3A is a perspective view of a resistance device of the exercise machine shown in FIG. 1.
Figure 3B:
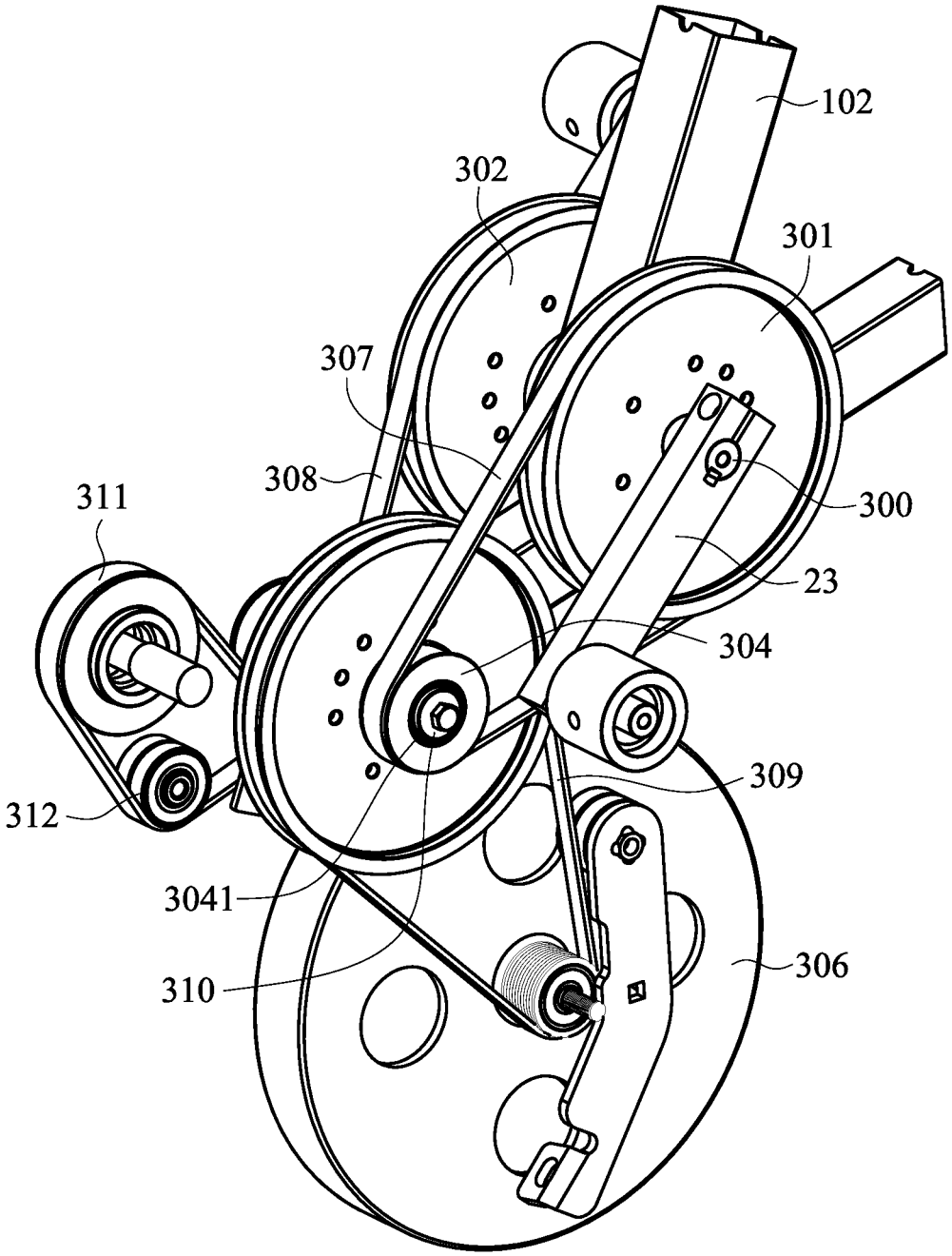
FIG. 3B is a perspective view of another perspective view of the resistance device of the exercise machine shown in FIG. 1.
Figure 3C:
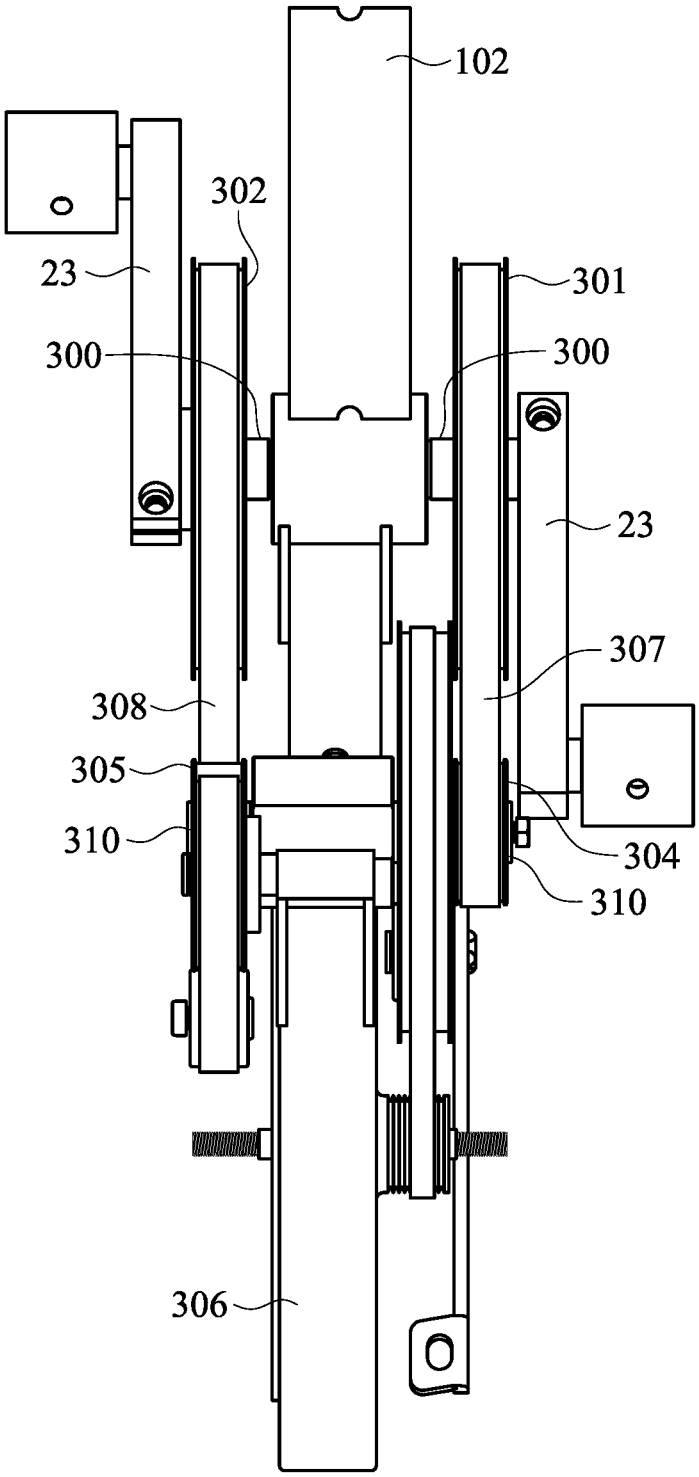
FIG. 3C is a side view of the resistance device of the exercise machine shown in FIG. 1.

FIGS. 3A and 3B are perspective views of the resistance device 30 in two different viewing angles. FIG. 3C is a side view of the resistance device 30 of FIG. 1. As shown in FIGS. 3A, 3B, and 3C, the resistance device 30 mainly includes the first axle 300, a first transmission wheel 301, a second transmission wheel 302, a third transmission wheel 303, a fourth transmission wheel 304, a fifth transmission wheel 305, a flywheel 306, a first transmission member 307, a second transmission member 308, a third transmission member 309, and a second axle 310.

As shown in FIGS. 3A, 3B, and 3C, the first transmission wheel 301 and the second transmission wheel 302 are respectively disposed at the left side and right side of the frame 102, and the first axle 300 is a common axle for the first transmission wheel 301 and the second transmission wheel 302. The first axle 300 passes through the frame 102 and includes two ends respectively connects with the first end of one crank 23. The two cranks 23 are oppositely disposed by 180 degrees, and the kinetic energy generated by operating the pedals 206 is transmitted to the first axle 300 through the cranks 23, and then transmitted from the first axle 300 to the first transmission wheel 301 and the second transmission wheel 302, so as to drive the first transmission wheel 301 and the second transmission wheel 302 to rotate.

As shown in FIGS. 3A, 3B, and 3C, the fourth transmission wheel 304 and the fifth transmission wheel 305 are respectively disposed at the left side and right side of the third transmission wheel 303, and the second axle 310 passes through the frame 102 and is a common axle for the third transmission wheel 303, the fourth transmission wheel 304, and the fifth transmission wheel 305. The first transmission wheel 301 is connected to the fourth transmission wheel 304 through the first transmission member 307, and the second transmission wheel 302 is connected to the fifth transmission wheel 305 through the second transmission member 308. The rotation of the first transmission wheel 301 and the second transmission wheel 302 will cause the fourth transmission wheel 304 and the fifth transmission wheel 305 to rotate. It is appreciated that the fourth transmission wheel 304 rotates in a first direction and the fifth transmission wheel 305 rotates in a second direction opposite to the first direction, or vice versa. In addition, as shown in FIG. 3B, a first one-way bearing 3041 is disposed between the first transmission wheel 304 and the second axle 310; as shown in FIG. 3A, a second one-way bearing 3051 is disposed between the fifth transmission wheel 305 and the second axle 310.

As shown in FIGS. 3A, 3B, and 3C, the third transmission wheel 303 is coupled to the flywheel 306 through the third transmission member 309. The rotation of the third transmission wheel 303 will cause the flywheel 306 to rotate. In the present embodiment, the third transmission wheel 303 and the flywheel 306 rotate in a same direction. In another embodiment of the present invention, the third transmission wheel 303 and the flywheel 306 are rotated in two directions opposite to each other by disposing the third transmission member 309 a different way.

Referring to FIGS. 3A, 3B, and 3C, preferably, the first transmission wheel 301, the second transmission wheel 302, the third transmission wheel 303, the fourth transmission wheel 304, and the fifth transmission wheel 305 are pulleys, and the first transmission member 307, the second transmission member 308, and the third transmission member 309 are belts.

Referring to FIGS. 3A, 3B, and 3C, in the present embodiment, the resistance device 30 may further include a sixth transmission wheel 311 and a seventh transmission wheel 312. The sixth transmission wheel 311 and the seventh transmission wheel 312 are disposed at a side of the third transmission wheel 303, and the second transmission member 308 is connected to the second transmission wheel 302, the fifth transmission wheel 305, the sixth transmission wheel 311, and the seventh transmission 312. The sixth transmission wheel 311 and the seventh transmission wheel 312 are used to tighten and spread the second transmission member 308, so as to adjust the tension of the second transmission member 308. Preferably, both the sixth transmission wheel 311 and the seventh transmission wheel 312 are pulleys.

Figure 4:
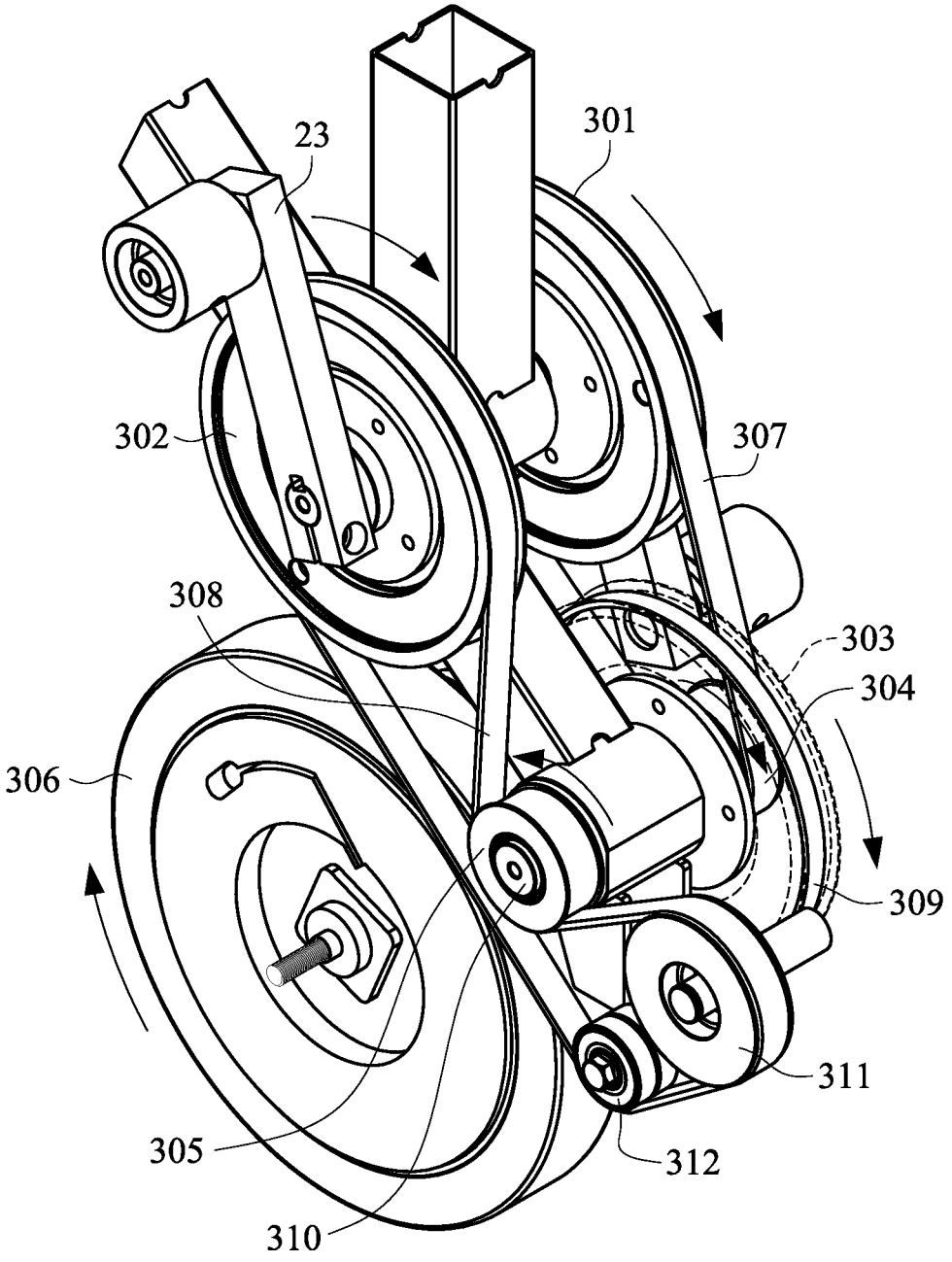
FIG. 4 is a schematic diagram showing the operation of the resistance device of the exercise machine of FIG. 1.
Figure 5:
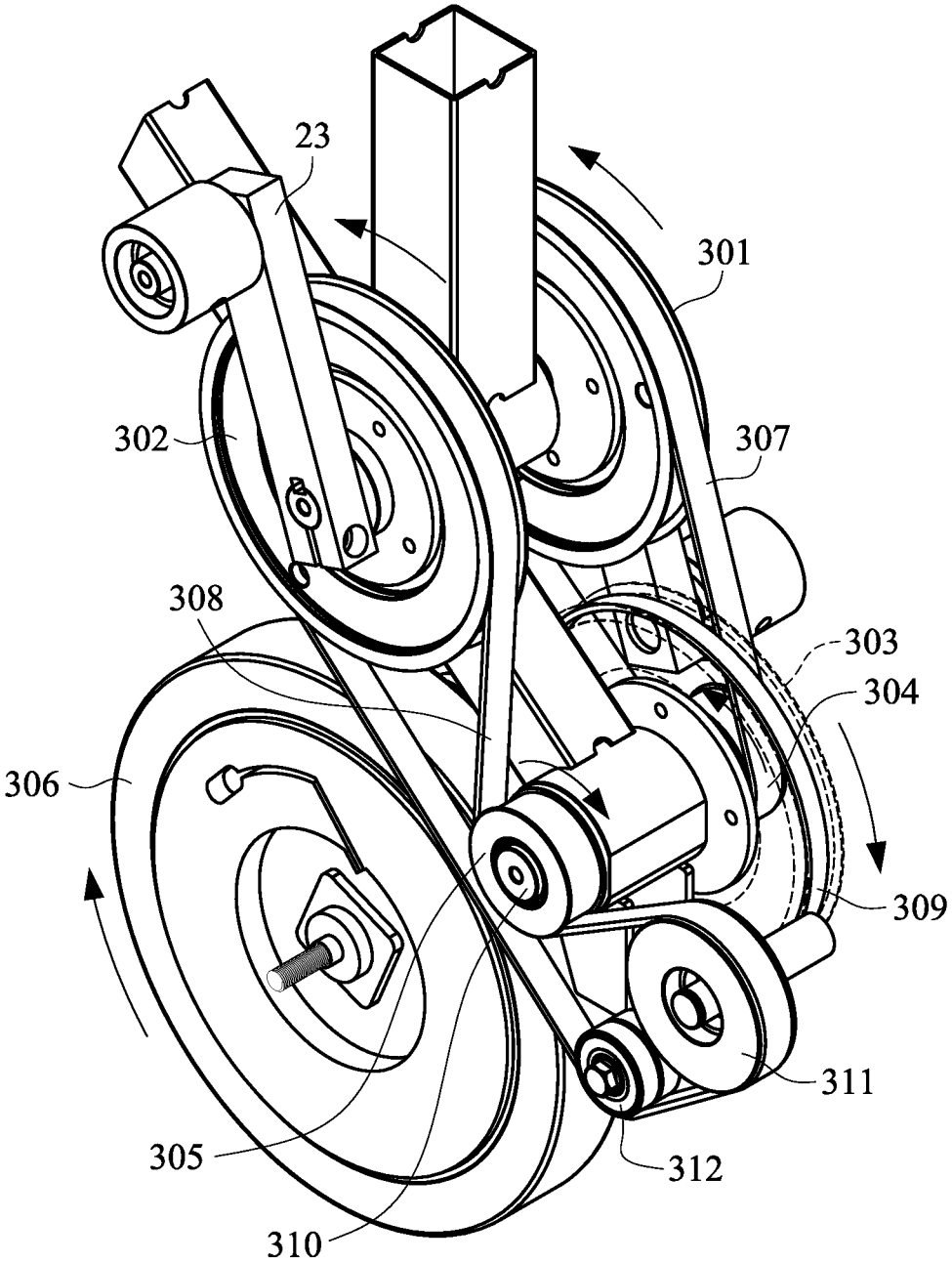
FIG. 5 is a schematic diagram showing the operation of the resistance device of the exercise machine of FIG. 1.

FIGS. 4 and 5 are schematic diagrams showing the operation of the resistance device 30 of the exercise machine 1 according to an embodiment of the present invention, wherein the exercise machine is operated in small pace. In the context, "large pace" means that each pedal 206 is reciprocated at its highest position and the lowest position, and "small pace" means that each pedal 206 is operated with a reciprocal path that is shorter than the "large pace."

Referring to FIG. 4, when the user operates the pedal 206, the kinetic energy is transmitted from the crank 23 to the first axle 300 and drives the first transmission wheel 301 and the second transmission wheel 302 to rotate in a first direction (for example, clockwise). The first transmission wheel 301 drives the fourth transmission wheel 304 to rotate in a first direction, and the second transmission wheel 302 drives the fifth transmission wheel 305 to rotate in a second direction (for example, counterclockwise). At this time, the second one-way bearing 3051 in the fifth transmission wheel 305 is loosened from the second axle 310, and the first one-way bearing 3041 in the fourth transmission wheel 304 is engaged with the second axle 310. At this time, the kinetic energy is transmitted from the fourth transmission wheel 304 to the second axle 310, causing the rotation of the third transmission wheel 303, which in turn transmits kinetic energy to the flywheel 306 and then causes the flywheel 306 to rotate. In the present embodiment, the flywheel 306 also rotates in a first direction (e.g., clockwise). In another embodiment, the flywheel 306 is rotated in a second direction (e.g., counterclockwise) by disposing the third transmission member 309 in a different way.

Referring to FIG. 5, when the user operates the pedal 206, the kinetic energy is transmitted from the crank 23 to the first axle 300 and drives the first transmission wheel 301 and the second transmission wheel 302 to rotate in the second direction (for example, counterclockwise). The first transmission wheel 301 drives the fourth transmission wheel 304 to rotate in the second direction, and the second transmission wheel 302 drives the fifth transmission wheel 305 to rotate in the first direction (for example, clockwise). At this time, the second one-way bearing 3051 in the fifth transmission wheel 305 is engaged with the second axle 310, and the first one-way bearing 3041 in the fourth transmission wheel 304 is loosened from the second axle 310. The kinetic energy is transmitted from the fifth transmission wheel 305 to the second axle 310, causing the rotation of the third transmission wheel 303, which in turn transmits kinetic energy to the flywheel 306 and causes the flywheel 306 to rotate. In the present embodiment, the flywheel 306 also rotates in a second direction (e.g., counterclockwise). In another embodiment, the flywheel 306 is rotated in a first direction (e.g., clockwise) by disposing the third transmission member 309 in a different way.

In addition, when the exercise machine 1 according to the embodiment of the present invention is operated in the "large pace", the operation of the resistance device 30 is similar to FIG. 4 due to the inertia of the flywheel 306. The kinetic energy is transmitted by the crank 23 to the first axle 300 and drives the first transmission wheel 301 and the second transmission wheel 302 to rotate in a first direction (e.g., clockwise). The first transmission wheel 301 drives the fourth transmission wheel 304 to rotate in the first direction, and the second transmission wheel 302 drives the fifth transmission wheel 305 to rotate in a second direction (for example, counterclockwise). At this time, the second one-way bearing 3051 in the fifth transmission wheel 305 is loosened from the second axle 310, and the first one-way bearing 3041 in the fourth transmission wheel 304 is engaged with the second axle 310. The kinetic energy is transmitted from the fourth transmission wheel 304 to the second axle 310, causing the rotation of the third transmission wheel 303, which in turn transmits kinetic energy to the flywheel 306 and then causes the flywheel 306 to rotate.

According to the preferred embodiment of the present invention, the exercise machine 1 can be smoothly operated with the "small pace", regardless the first transmission wheel 301 and the second transmission wheel 302 being rotated in the first direction or the second direction. The kinetic energy is instantaneously transmitted to the third transmission wheel 303, thereby causing the flywheel 306 to continually rotate in a specific direction. There is no retardation when the operation direction is switched and the exercise machine 1 can be smoothly operated.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

All of the contents of the preceding documents are incorporated herein by reference in their entireties. Although the disclosure herein refers to certain illustrated embodiments, it is to be understood that these embodiments have been presented by way of example rather than limitation. For example, any of the particulars or features set out or referenced herein, or other features, including method steps and techniques, may be used with any other structure(s) and process described or referenced herein, in whole or in part, in any combination or permutation as a non-equivalent, separate, non-interchangeable aspect of this invention. Corresponding or related structure and methods specifically contemplated and disclosed herein as part of this invention, to the extent not mutually inconsistent as will be apparent from the context, this specification, and the knowledge of one skilled in the art, including, modifications thereto, which may be, in whole or in part, (i) operable and/or constructed with, (ii) modified by one skilled in the art to be operable and/or constructed with, and/or (iii) implemented/made/used with or in combination with, any parts of the present invention according to this disclosure, include: (I) any one or more parts of the above disclosed or referenced structure and methods and/or (II) subject matter of any one or more of the inventive concepts set forth herein and parts thereof, in any permutation and/or combination, include the subject matter of any one or more of the mentioned features and aspects, in any permutation and/or combination.

Although specific embodiments have been illustrated and described, it will be appreciated by those skilled in the art that various modifications may be made without departing from the scope of the present invention, which is intended to be limited solely by the appended claims.

What is claimed is:

1. An exercise machine, comprising:

a supporting mechanism comprising a base located on a supporting plane or a floor and a frame located on the base and connected to the base;

two pedal-operated driving units being respectively disposed at a left side and a right side of the frame for the user to operate; and a resistance device comprising:

a first transmission wheel being disposed at a first side of the frame;

a second transmission wheel being disposed at a second side of the frame;

a first axle passing through the frame and being a common axle of the first transmission wheel and the second transmission wheel, the first axle having two ends with each connecting to one corresponding pedal-operated driving unit;

a third transmission wheel being rotatably mounted on the frame;

a fourth transmission wheel being disposed at a first side of the third transmission wheel;

a fifth transmission wheel being disposed at a second side of the third transmission wheel;

a second axle passing through the frame and being a common axle of the third transmission wheel, the fourth transmission wheel, and the fifth transmission wheel;

a first one-way bearing being disposed between the fourth transmission wheel and the second axle;

a second one-way bearing being disposed between the fifth transmission wheel and the second axle;

a flywheel being rotatably mounted on the frame;

a first transmission member connecting the first transmission wheel and the fourth transmission wheel;

a second transmission member connecting the second transmission wheel and the fifth transmission wheel;

a third transmission member connecting the third transmission wheel and the flywheel;

wherein the fourth transmission wheel rotates in a first direction and the fifth transmission wheel rotates in a second direction opposite to the first direction, and wherein the kinetic energy of the two pedal-operated driving units is transmitted to the third transmission wheel via one of the fourth transmission wheel and the fifth transmission wheel, and then the third transmission wheel drives the flywheel to rotate.

2. The exercise machine as recited in claim 1, wherein the first transmission wheel, the second transmission wheel, the third transmission wheel, the fourth transmission wheel, and the fifth transmission wheel are pulleys, and the first transmission member, the second transmission member, and the third transmission member are belts.

3. The exercise machine as recited in claim 2, wherein the resistance device further comprises a sixth transmission wheel and a seventh transmission wheel both disposed at the second side of the third transmission wheel, and wherein the second transmission member connects to the second transmission wheel, the fifth transmission wheel, the sixth transmission wheel, and the seventh transmission wheel, and the sixth transmission wheel and the seventh transmission wheel are used for adjusting a tension of the second transmission member.

4. The exercise machine as recited in claim 1, wherein the first transmission wheel, the second transmission wheel, and the fourth transmission wheel rotate in a same direction.

5. The exercise machine as recited in claim 1, wherein the third transmission wheel and the flywheel rotate in a same direction.

6. The exercise machine as recited in claim 1, wherein the third transmission wheel rotates in a first direction, and the flywheel rotates in a second direction opposite to the first direction.

7. The exercise machine as recited in claim 1, wherein each of the two pedal-operated driving units comprises:

a swing rod having a first end pivotally connected to the frame;

a foot rod having a first end pivotally connected to a second end of the swing rod;

a crank having a first end connected to the first axle;

a linkage rod having a first end pivotally connected to a second end of the crank and having a second end pivotally connected to a portion between the first end and the second end of the foot rod;

a limiting rod having a first end fixed to the frame and having a second end fixed to the base;

a pedal connecting to a second end of the foot rod.

8. The exercise machine as recited in claim 7, wherein the limiting rod is curve-shaped.

9. The exercise machine as recited in claim 7, wherein each of the two pedal-operated driving units further comprises a roller that comprises an axis pivoted to an outer side surface between the first end and the second end of each of the respective foot rods.

10. The exercise machine as recited in claim 9, wherein each of the two rollers comprises a concave groove to fit each of the respective limiting rods.

* * * * *